United States Patent [19]

Milton

[11] 4,074,548

[45] Feb. 21, 1978

[54] LOCK CYLINDER ASSEMBLY

[75] Inventor: Thomas J. Milton, Essexville, Mich.

[73] Assignee: General Motors Corporation, Detroit, Mich.

[21] Appl. No.: 748,491

[22] Filed: Dec. 8, 1976

[51] Int. Cl.[2] ..... E05B 63/00

[52] U.S. Cl. ..... 70/1.5; 70/422

[58] Field of Search ..... 70/422, 1.5, 1.7, 416, 70/417, 418, 419, 421

[56] References Cited

U.S. PATENT DOCUMENTS

| | | | |
|---|---|---|---|
| 1,789,759 | 1/1931 | Jacobi | 70/422 |
| 2,004,434 | 6/1935 | Fitz Gerald | 70/1.5 |
| 2,031,155 | 2/1936 | Fitz Gerald | 70/1.5 |
| 4,008,588 | 2/1977 | Miller | 70/419 |

*Primary Examiner*—Robert L. Wolfe
*Attorney, Agent, or Firm*—Charles E. Leahy

[57] ABSTRACT

A lock cylinder assembly for a motor vehicle ignition switch includes a lock core rotatable in a cylindrical opening of a cyclindrical sleeve anchored in a housing. A lock bar acts between the core and the sleeve to normally lock the core against rotation and to unlock the core to permit rotation when a properly bitted key is inserted into a key slot of the core. A frangible retainer acts between the core and the sleeve to define a normal axial relation therebetween and fractures under an axial extracting force to permit axial outward movement of the core relative the sleeve. A second retainer acts between the sleeve and the core and is effective upon limited axial movement of the core permitted by fracture of the frangible retainer to block further axial movement and rotational movement of the core relative the sleeve. The core has a weakened cross section intermediate the key slot and the second retainer whereby the core is fractured and a core inner portion is retained in the housing by the second retainer while a core outer portion is removed. The sleeve has a weakened cross section located at an axial location along the lock bar to permit fracture of the sleeve by the force transmitted thereto by the lock bar during extraction of the core so that a sleeve outer portion is also removed from the housing with the core outer portion, while the sleeve inner portion and core inner portion remain in the housing.

3 Claims, 15 Drawing Figures

LOCK CYLINDER ASSEMBLY

The invention relates to a lock cylinder assembly and more particularly to a lock cylinder assembly having frangible sleeve and core elements which illustrate forced disassembly of the lock cylinder assembly by a thief.

It is well known in motor vehicles to provide a lock cylinder assembly which prevents unauthorized operation of the motor vehicle by preventing operation of the ignition switch without the use of a properly bitted key.

Such a lock cylinder assembly conventionally includes a core which is rotatable in a cylindrical sleeve or housing to move the ignition switch between circuit closing and circuit opening positions. A lock bar is mounted in the core for radial movement between a radially extended position engaging a mating recess in the sleeve to block rotation of the core and a retracted position permitting rotation of the core relative the housing. The lock cylinder assembly prevents unauthorized operation of the vehicle by preventing rotation of the core to close the ignition switch until a properly bitted key is inserted into a key slot of the core to retract the lock bar from engagement with the housing and permit rotation of the core to close the switch.

Professional automobile thieves are known to defeat automotive ignition lock cylinder assemblies by forcibly extracting the core from the lock. This extraction is achieved by threading a hardened self-tapping screw into the open end of the key slot. A so-called slap hammer or dent puller is then employed to exert an axial extracting force on the screw to pull the core out of the housing.

It is well known that the efforts of a thief may be frustrated by incorporating hardened armor elements into the lock. For example, a hardened armor plate staked to the outer face of the core and having a key slot which registers with the key slot of the core will frustrate the threading of a hardened screw into the key slot.

The object, feature and advantage of the present invention is the provision of a further improvement in the security of lock cylinder assemblies by providing means by which the core and the sleeve fracture at a predetermined axial location so that a portion of the core and sleeve will remain in the housing even though that portion of the core having the key slot and an outer portion of the sleeve are successfully extracted by the thief. The remaining portion of the core and sleeve cannot be grasped by the thief because there is no preexisting opening such as a key slot into which a hardened screw may be threaded.

According to the invention, a lock cylinder assembly for a motor vehicle ignition switch includes a lock core rotatable in a cylindrical opening of a cylindrical sleeve anchored in a housing. A lock bar acts between the core and the sleeve to normally lock the core against rotation. A plurality of tumblers in the core operate the lock bar to unlock the core for rotation when a properly bitted key is inserted into a key slot of the core. A frangible retaining means acts between the core and the sleeve to define a normal axial relation therebetween and fractures under an axial extracting force to permit axial outward movement of the core relative the sleeve. A second retaining means acting between the sleeve and the core is effective upon limited axial movement of the core permitted by fracture of the frangible retaining means to block further axial movement and rotational movement of the core relative the sleeve. The core has a weakened cross section intermediate the key slot and the second retaining means whereby the core is fractured and a core inner portion is retained in the housing by the second retaining means while a core outer portion is removed. The sleeve has a weakened cross section located at an axial location along the lock bar to permit the fracture of the sleeve by the force transmitted thereto by the locking bar during extraction of the core so that a sleeve outer portion is also removed from the housing with the core outer portion, while the sleeve inner portion and the core inner portion remain in the housing.

These and other objects, features and advantages of the invention will become apparent upon cosideration of the specification and the appended drawings in which:

FIGS. 1-6 are side elevation views of one embodiment of the invention having parts broken away and in section and illustrating the sequence of operation of the invention;

FIGS. 7 - 11 discloses another lock cylinder assembly, FIG. 7 showing a side elevation view having parts broken away and in section;

Figure 12:
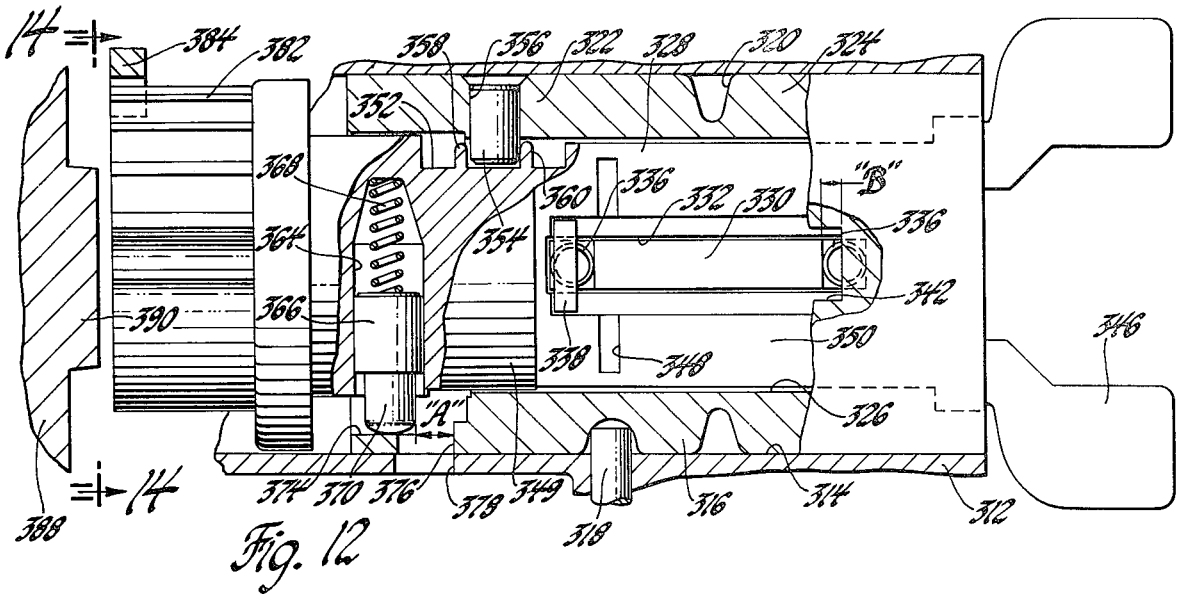
Figure 13:
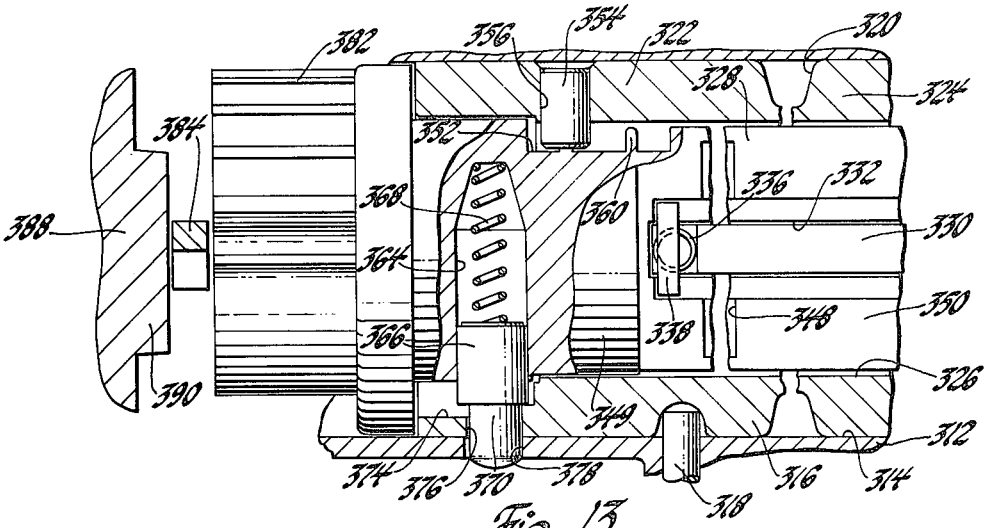
Figure 14:
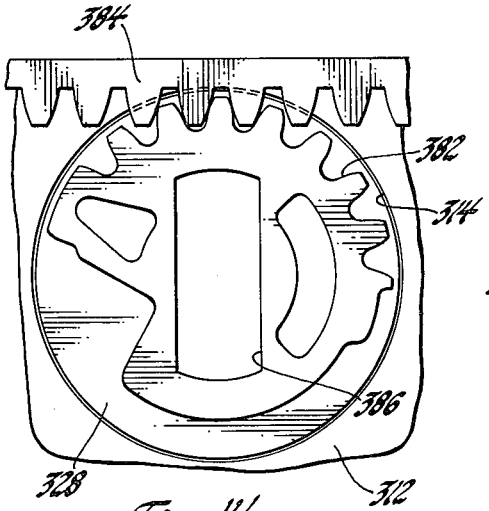
Figure 15:
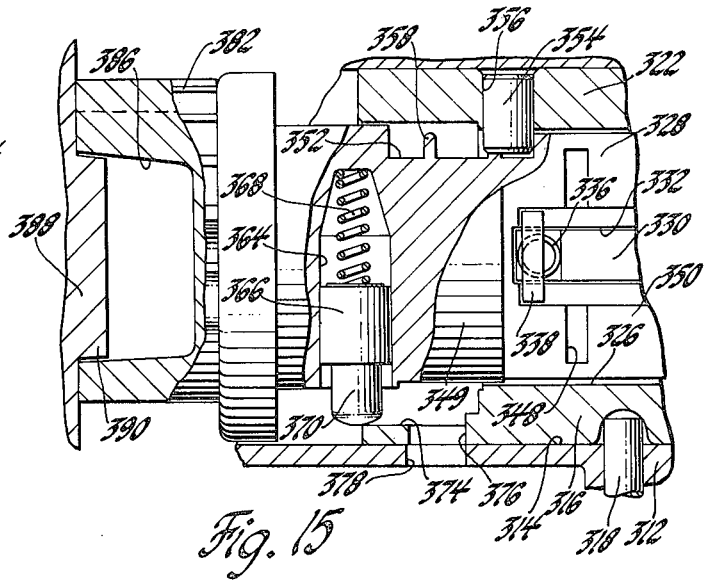

FIGS. 12 - 15 disclose another embodiment of the invention, FIG. 12 showing a side elevation view having parts broken away and in section;

FIG. 13 is a view similar to FIG. 12 but showing the forced extraction and fracture of the lock cylinder assembly;

FIG. 14 is a view taken in the direction of arrows 14—14 of FIG. 12; and FIG. 15 is a view similar to FIG. 12 but showing forced inward movement of the lock cylinder assembly into the housing.

Figure 1:
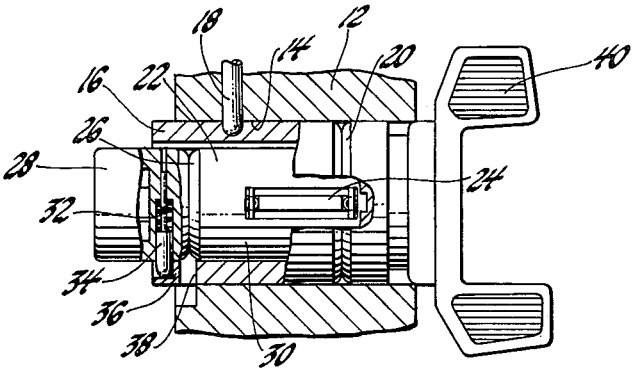

Referring now to FIGS. 1 - 6 there is shown a sequential representation of the function of this invention. As seen in FIG. 1, a housing 12 of a motor vehicle member such as a sterring column defines a cylindrical opening 14. A round cylindrical sleeve 16 is retained within the opening 14 by a retainer 18 which fixes the rotational and longitudinal position of the sleeve 16 relative the housing 12. The sleeve 16 has a circumferentially extending groove 20 adjacent its outer end.

A round cylindrical lock core 22 is rotatably journalled in the sleeve 16. The core 22 carries a conventional key operated tumbler and a side lock bar 24 which extends radially outward the outer surface of the core 22 and for engagement in a mating slot in the sleeve 16 to block rotation of the core 22 in the sleeve 16. Insertion of a properly bitted key into a key slot in the outer face of the core 22 withdraws the lock bar 24 from the slot in the sleeve 16 to permit rotation of the core 22.

The core 22 is suitably connected with an ignition switch to operate the switch between various conditions when the core 22 is rotated. A circumferentially extending groove 26 divides the core into an inner portion 28 and outer portion 30. A radial bore 32 in inner portion 28 slidably houses a spring biased detent pin 34.

The detent pin 34 coacts with a web member 36 having axial and radial walls so that core 22 may rotate relative the sleeve 16 but the radial wall of the web member 36 blocks extraction of the core 22 from sleeve 16.

Figure 2:
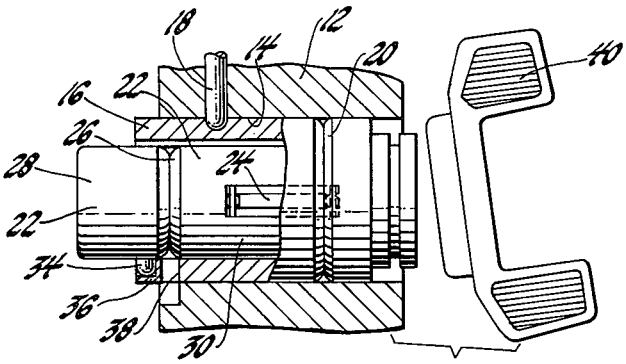

A bezel 40 is affixed to the outer end of core 22 and facilitates rotation of the core 22 when the properly bitted key is inserted thereinto. FIG. 2 shows the breakaway of the bezel 40 upon an attempt to forcibly rotate or extract the core 22 by application of force to the bezel 40.

Figure 3:
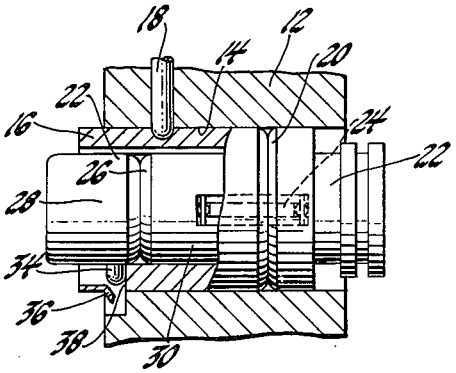

FIG. 3 shows the effect of a forced longitudinal extraction of the core 22 as by a hardened screw threaded into the open end of the key slot. This forced extraction causes the radial wall of web member 36 to deform so that detent pin 34 may move axially outwardly with the core 22. This axial outward movement of the detent pin 34 carries it into an aligned recess 38 in the sleeve 16. The recess 38 captures the detent pin 34 so that the inner portion 28 of core 22 cannot be rotated or extracted from the sleeve 16.

Figure 4:
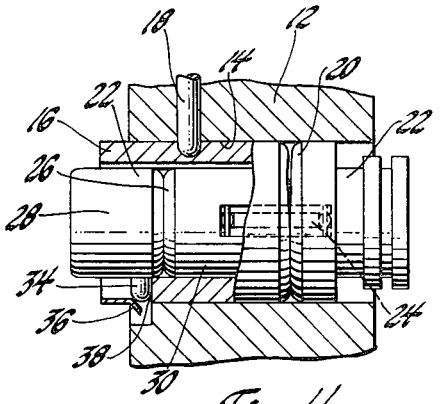

As shown in FIG. 4, a further extracting force applied to the core 22 is transmitted to the sleeve 16 by the lock bar 24, thus causing fracture of the sleeve 16 at the circumferentially extending groove 20.

Figure 5:
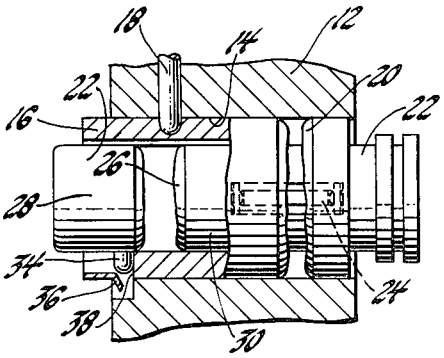

Referring now to FIG. 5, it is seen that continued extraction induces fracture of the core 22 at the circumferentially extending groove 26. It will be understood that the time sequence of fracture of the core 22 and sleeve 16 may be controlled by the designer's selection of the relative amount of axial free travel between detent pin 34 and the recess 38 as well as between the lock bar 24 and the mating lock bar slot in the sleeve 16.

Figure 6:
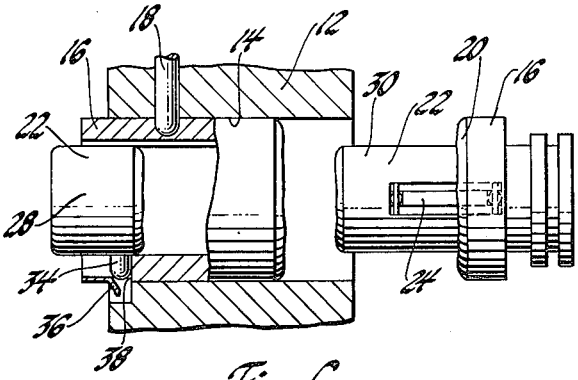

Accordingly, as seen in FIG. 6, the outer portion 30 of core 22 and a portion of the sleeve 16 as well as the lock bar 24 acting therebetween are removed from the housing 12. The inner portion 28 of core 22 which remains within the sleeve 16 and housing 12 at a position fixed by the engagement of detent pin 34 in the recess 38 does not have a key slot or other opening in its face so that it cannot be gripped by a hardened screw or like extracting tool. Thus, it is seen that fracture of the lock cylinder assembly will defeat an attempt to forcibly disassemble the ignition lock.

Figure 7:
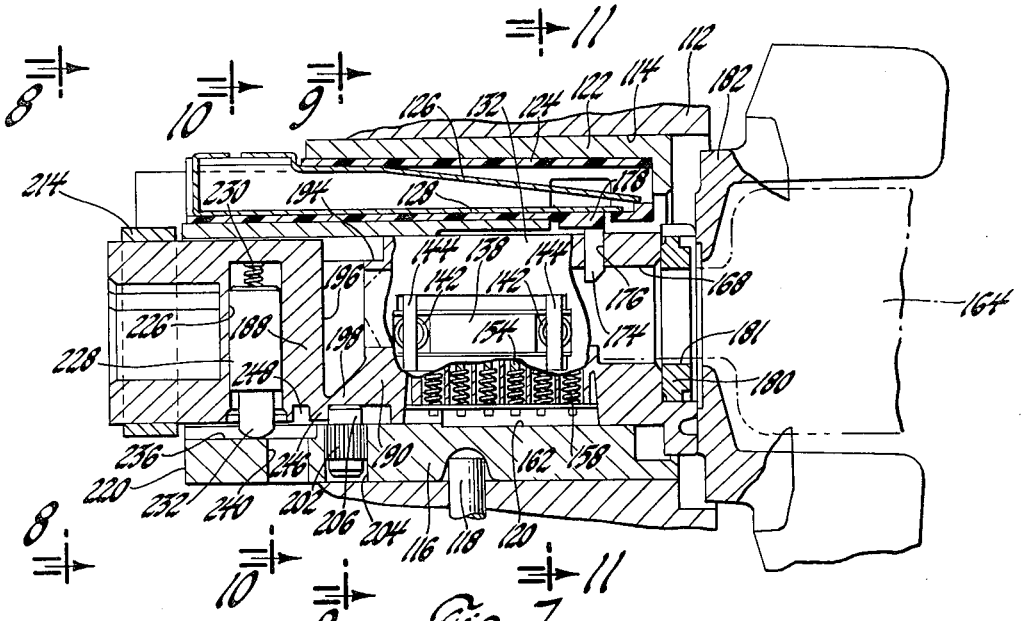

Another lock cylinder construction is disclosed in FIGS. 7 – 11. Referring to FIG. 7, a housing 112, such as a steering column housing, has an axial bore 114. A cylindrical sleeve 116 is retained at a fixed rotational and axial position in the bore 114 by a retainer 118 which acts between housing 112 and sleeve 116.

The sleeve 116 has an axial bore 120. The sleeve 116 also has a switch housing 122 which houses a buzzer switch assembly comprised of a plastic housing 124 which mounts spaced apart upper and lower contacts 126 and 128. The switch contacts 126 and 128 are connected to a buzzer circuit for sounding an audible alarm to remind the driver to remove the key when the lock is turned to the off position.

Figure 11:
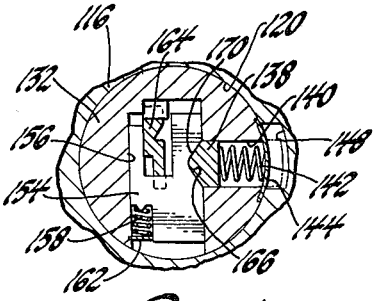
FIG. 11 is a sectional view taken in the direction of arrows 11—11 of FIG. 7.

A cylindrical core 132 is rotatable within the axial bore 120 of sleeve 116. Referring to FIGS. 7 and 11, it is seen that the locking arrangement between the core 132 and the sleeve 116 is provided by a side lock bar 138 which is mounted in a radially extending slot 140 of the core 132. At each end of the lock bar 138, there is a coil compression spring 142 acting between the lock bar 138 and a spring seat 144 carried by the core 132 to urge the lock bar 138 to its unlocked position of FIG. 11. The lock bar 138 is movable to carry its outer end to the phantom line indicated position of FIG. 11 wherein the outer end of the lock bar 138 extends into a slot 148 in the sleeve 116 to lock the core 132 against rotation relative the sleeve 116. A plurality of tumblers 154 are movably housed in recesses 156 provided in the core 132. Coil compression springs 158 act between the tumblers 154 and a spring seat 162 carried by the core 132. When a properly bitted key 164 is entered into a key slot 168 of the core 132, the tumblers 154 are all moved to the position of FIG. 11 wherein notches 166 become aligned with mating surfaces 170 of the lock bar 138 allowing movement of the lock bar from the phantom line indicated locking position of FIG. 11 to the solid-line unlocking position of FIG. 11. Accordingly, when the properly bitted key is entered into the key slot the core 132 is freed for rotation relative the sleeve 116 to actuate the ignition switch.

As best seen in FIG. 7, a buzzer switch operator 174 is movable mounted in a radial hole 176 of the core 132 and communicates between the key slot 168 and a flexible leaf 178 of the plastic housing 124 to move switch contact 128 into switch closing engagement of the upper contact 126 when the key 164 is inserted in the key slot 168. As also seen in FIG. 7, a hardened armor plate 180 seats in a recess of the outer end of core 132 and is attached to the core 132 by swaging the core 132 over the armor plate 180. The armor plate 180 has a key slot 181 which is aligned with the key slot 168 of the core 132 and resists the threading of a hardened screw into the key slot. A knob or bezel 182 is also swaged to the outer face of core 132 and provides a convenient grip by which the driver may rotate the core 132 subsequent to insertion of a properly bitted key.

Figure 9:
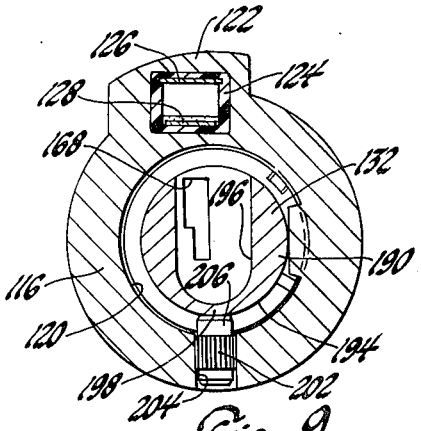
FIG. 9 is a sectional view taken in the direction of arrows 9—9 of FIG. 7.

Referring to FIGS. 7 and 9, it is seen that the core 132 is divided into an inner portion 188 and outer portion 190 by a circumferential groove 194 and a radial recess 196 which leave the inner portion 188 and outer portion 190 connected by a U-shaped neck 198.

Referring to FIG. 9, it is seen that a retaining pin 202 is press fit in a radial bore 204 of sleeve 116 and has an inner end 206 which projects past the periphery of the core 132 and rides in the circumferential groove 194 of core 132 so that retaining pin 202 does not restrain rotation of the core 132.

Figure 8:
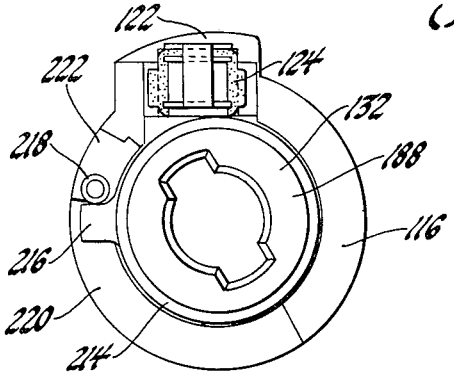
FIG. 8 is an end view taken in the direction of arrows 8—8 of FIG. 7.

Referring to FIGS. 7 and 8, a ring 214 is press fit into the innermost end of the core inner portion 188 and has a radially projecting lug 216. When the core 132 is in its off lock position of FIG. 8, the lug 216 engages a roll pin 218 which projects from the end surface 220 of sleeve 116 and has its outer end flush with a stepped surface 222. When it is desired to rotate the core 132 to the accessory switch position which energizes electrical circuitry for the radio and other accessory equipment, the core 132 is pushed inwardly the sleeve 116 so that the lug 216 will clear the end of roll pin 218 and the stepped surface 222 to permit rotation of the core 132 to the accessory position.

The circumferential groove 194 of core 132 extends axially somewhat of the retaining pin 202 to permit the core 132 to move axially inwardly the sleeve 116 as is conventionally required for movement of the core 132 past a detent to permit rotation of the core 132 to the accessory switch position.

Figure 10:
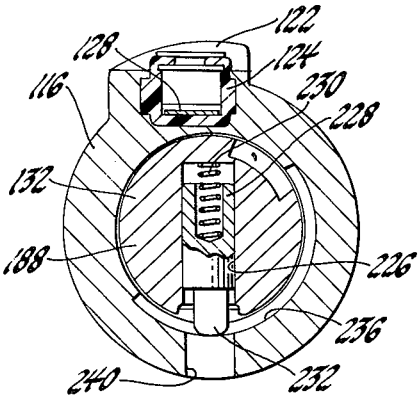
FIG. 10 is a sectional view taken in the direction of arrows 10—10 of FIG. 7.

Referring to FIGS. 7 and 10, it is seen that the inner portion 188 of core 132 has a radial bore 226 in which a detent pin 228 is slidable. A coil compression spring 230 acts between the core 132 and detent pin 228 urging the radially outer end 232 of the detent pin 228 into engagement of a recess wall 236 of the sleeve 116. The sleeve 116 has a radial bore 240 which is located axially outward of the detent pin 288 but is radially aligned with the detent pin when the core is in the off lock position as best seen in FIG. 10. During normal rotation of the core 132 by a properly bitted key, the outer end 232 of detent pin 228 rides against the sleeve in the recess 236.

Referring to FIG. 7, and assuming that a thief removes the bezel 182, removes the hardened armor plate 180 and successfully screws a self-tapping screw into the key slot 168, it is seen that axial outward extraction of the core 132 is impeded by engagement of the retaining pin 202 with a thin wall 246 between the circumferential groove 194 and a core recess 248. The wall 246 breaks under an axial extracting force of about 300 lbs. permitting the core to be extracted and the press fit ring 214 slips on the core inner portion 188. As the axial outward extracting travel of the core 132 continues, the detent pin 228 is carried into alignment with the radial bore 240 in the sleeve so that the coil compression spring 230 projects the detent pin 228 radially outward to engage outer end 232 in the radial bore 240. This engagement of the detent pin 228 in the radial bore 240 prevents further axial extracting movement of the inner core portion 188 and also prevents rotation of that portion of the core. Further and continued application of axial extracting force to the core 132 causes the U-shaped neck 198 of the core to break so that the core outer portion 190 is separated from the core inner portion 188 and may be completely removed from sleeve 116. It will be understood that the lock bar receiving slot 148 of the sleeve 116 is open at its outer end so that the lock bar 138 does not offer any restraint against extraction of the core 132.

Another lock cylinder embodying the invention is disclosed in FIGS. 12 through 15. Referring to FIG. 12, a housing 312, such as a steering column housing, has an axial bore 314. A cylindrical sleeve 316 is retained at a fixed rotational and axial position in the bore 314 by a retainer 318 which acts between housing 312 and a recess in the sleeve 316. The sleeve 316 has a circumferential groove 320 in its outer surface at a location axially outwardly from the retainer 318 and which divides the sleeve 316 into a sleeve inner portion 322 and a sleeve outer portion 324.

The sleeve 316 has an axial bore 326, in which a cylindrical core 328 is rotatable. The locking arrangement between the core 328 and the sleeve 316 is provided by a side lock bar 330 which is mounted in a radially extending slot 332 of the core 328. At each end of the lock bar 330, there is a coil compression spring 336 having one end seated in a recess of the lock bar and the other end seated on a spring seat 338 carried by the core 328. The lock bar springs 336 urge the lock bar 330 toward an unlocked position. A plurality of core-mounted, key-operated tumblers within core 328 normally maintain the lock bar 330 in its locked position wherein the outer end of the lock bar 330 extends beyond the outer surface of core 328 and into a slot 342 in the sleeve 316 to lock the core 328 against rotation. When a properly bitted key is entered into a key slot provided in the outer face of the core 328, the tumblers are all moved to positions allowing the lock bar springs 336 to withdraw lock bar 330 from the slot 342 and free the core 328 for rotation relative the sleeve 316 to actuate the ignition switch. A knob or bezel 346 is swaged to the outer face of core 328 and provides a convenient grip by which the driver may rotate the core 328 subsequent to insertion of a properly bitted key.

The core 328 has a plurality of weakening recesses 348 displayed at predetermined locations about its periphery at an axial location somewhere along the lock bar 330, and dividing the core 328 into a core inner portion 349 and a core outer portion 350. Core 328 also has a circumferential recess 352 on its outer surface. A retaining pin 354 is press fit into a radial bore 356 of sleeve 316 and projects beyond the bore 326 of sleeve 316 to ride in the recess 352. The core has radial walls 358 and 360 which are juxtaposed to the retaining pin 354 to block axial inward and outward movement of the core 328 relative the sleeve but permit rotation of the core.

The core inner portion 349 has a radial bore 364 in which a detent pin 366 is slidable. A coil compression spring 368 acts between the core and the detent pin 366 urging the outer end 370 of detent pin 366 into engagement of a wall 374 of the sleeve 316. The sleeve 316 and the housing 312 have radial aligned bores 376 and 378 which are located axially outward of the patent pin 366 but are radially aligned with the detent pin when the core 328 is in the off lock position. During normal rotation of the core 328 by a properly bitted key, the outer end 370 of detent pin 228 rides on the wall 374 of sleeve 316.

The core inner portion 349 has a pinion gear 382 formed integrally therewith as best seen in FIGS. 12 and 14. A rack member 384 has a plurality of teeth which mesh with the teeth of pinion gear 382. The rack member is operatively connected with an ignition switch, not shown, for operating the ignition switch between its various operating positions. As best seen in FIG. 14, the inner face of the core inner portion 349 has a rectangular recess 386. A housing member 388 located inwardly of the rear face of core inner portion 349 has an integral lug 390 having a rectangular shape adapted for mating engagement in the recess 386 of the core as will be discussed hereinafter.

Referring to FIG. 12, and assuming that a thief removes the bezel 346, and successfully screws a self-tapping screw into the key slot of core 328, it is seen that axial outward extraction of the core 328 would be impeded by engagement of the core radial wall 358 with the retaining pin 354. The application of the predetermined level of extracting force causes fracture of the radial wall 358 so that the core 328 would be moved outward toward its position of FIG. 13. This outward extracting travel of the core 328 is limited by the distance designated "A" between the outer end 370 of detent pin 366 and the wall of bores 376, 378. Upon extracting movement of the core 328 through the amount of free travel "A," the detent pin 366 will be projected outwardly by the compression spring 368 into bores 376 and 378 so that the core inner portion 349 is stopped against further extracting travel as well as block against forced rotation. Simultaneously, the axial extracting travel of the core 328 carries the lock bar 330 through an amount of free travel designated "B" between its outer end and the outer end of the lock bar slot 342 in the sleeve 316. The application of a sufficient axial extracting force subsequent to travel through their respective free travel distances "A" and "B" will result in fracture of the core 328 at the location of its weakening recesses 348 and fracture of the sleeve at its circumferential groove 320. It will be understood that the time sequence of the fracture of the core and sleeve can be controlled by the selection of the free travel dimensions "A" and "B."

Referring again to FIG. 13, it will be understood that the fracture of the core 328 will allow the lock bar 330 and the tumblers to either spill out of the lock assembly or permit their ease of removal by the thief. However, the core inner portion 349 remains locked within the sleeve inner portion 322 by engagement of the detent pin 366 in the bores 376, 378. Furthermore, as seen in FIG. 13, the axial extracting motion of the core inner portion 349 through the range of free travel "A" withdraws the pinion gear 382 from support of rack member 384 so that the rack member 384 falls down between the core inner portion 349 and the housing abutment 388. Accordingly, the operative connection between the core inner portion 349 and the ignition switch is terminated.

Referring now to FIG. 15, it is seen that a thief's attempt to defeat the ignition lock assembly by forced inward movement of the core 328 causes fracture of the radial wall 360 permitting inward travel of the core 328 and the engagement of its recess 386 over the mating lug 390 of housing 388 so that the core cannot be forcibly rotated to operate the ignition switch.

Thus, it is seen that the invention provides an improved lock cylinder assembly having frangible core and sleeve elements which frustrate forcible disassembly of the lock cylinder assembly by a theif.

The embodiments of the invention in which an exclusive property or privilege is claimed are defined as follows:

1. In a lock assembly having a sleeve mounted on a housing, a lock core rotatable in the sleeve and having a key receiving slot, and locking means acting between the core and the sleeve to normally lock the core against rotation in the sleeve and to unlock the core to permit rotation when a properly bitted key is inserted into the core, the improvement comprising:

frangible retaining means acting between the sleeve and the core to define the normal longitudinal relation therebetween and permit limited axial movement of the core relative the sleeve upon forced longitudinal extraction of the core from the sleeve;

second retaining means acting between the sleeve and core and being effective upon limited axial movement of the core relative the sleeve to block further axial movement of the core relative the sleeve;

and said sleeve and core having weakened cross sections whereby the sleeve and the core are both broken at their weakened cross sections upon forced axial extraction of the core.

2. The combination comprising: a housing having an opening therein, a sleeve located in the housing, means anchoring the sleeve in the housing, a lock core rotatable in the sleeve, locking means acting between the core and the sleeve to normally locked the core against rotation and to unlock the core to permit rotation when a properly bitted key is inserted into the core, frangible retaining means acting between the sleeve and the core to define a normal axial relation therebetween and fracturing to permit axial movement of the core relative the sleeve upon forced axial extraction of the core from the sleeve, said core having a weakened cross section defining a core inner portion and a core outer portion, second retaining means acting between the core and the sleeve and being effective upon limited axial movement of the core permitted by fracture of the frangible retaining means to block further axial movement of the core inner portion relative the sleeve whereby the core is fractured and the core inner portion retained in the sleeve while the core outer portion is removed, said sleeve having a weakened cross section located axially outward of the means anchoring the sleeve in the housing and defining a sleeve inner portion and a sleeve outer portion, said locking means transmitting the axial extracting force from the core to the sleeve outer portion whereby the sleeve is fractured at the weakened cross section and the sleeve outer portion removed from the housing with the core outer portion.

3. The combination comprising: a housing having an opening therein, a sleeve located in the housing and having a weakened cross section defining a sleeve inner portion and a sleeve outer portion, means anchoring the sleeve inner portion in the housing, a lock core rotatable in the sleeve and having a weakened cross section defining a core inner portion and a core outer portion, a key slot in the core outer portion, locking means carried by the core outer portion and acting between the core and the sleeve to normally lock the core against rotation and to unlock the core to permit rotation when a properly bitted key is inserted into the key slot, said sleeve and said core having radially projecting means projecting into juxtaposition with one another to define a normal axial relation therebetween, one of the radially projecting means being broken upon forced extraction of the core from the cylinder to permit outward axial movement of the core relative the sleeve, a detent member carried by the core inner portion, a recess in the sleeve located in radial alignment with the detent member when the core is locked and located axially outward of the detent member when the core is in the normal axial relation with respect to the housing so that the detent member is engaged in the recess upon outward axial extracting movement of the core permitted by fracture of the radially projecting means to block further axial extracting movement whereby the core is fractured and the core inner portion retained in the sleeve while the core outer portion is removed, said locking means transmitting the axial extracting force from the core to the sleeve outer portion whereby the sleeve is fractured at the weakened cross section and the sleeve outer portion removed from the housing with the core outer portion.

* * * * *